US011066196B2

(12) United States Patent
Kageyama et al.

(10) Patent No.: US 11,066,196 B2
(45) Date of Patent: Jul. 20, 2021

(54) WEIGHING AND PACKAGING APPARATUS

(71) Applicant: Ishida Co., Ltd., Kyoto (JP)

(72) Inventors: Toshiharu Kageyama, Ritto (JP); Yuji Okamoto, Ritto (JP); Mikio Kishikawa, Ritto (JP); Makoto Ichikawa, Ritto (JP); Satoshi Hashimoto, Ritto (JP); Hideshi Miyamoto, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 241 days.

(21) Appl. No.: 16/334,294

(22) PCT Filed: Aug. 18, 2017

(86) PCT No.: PCT/JP2017/029644
§ 371 (c)(1),
(2) Date: Mar. 18, 2019

(87) PCT Pub. No.: WO2018/051721
PCT Pub. Date: Mar. 22, 2018

(65) Prior Publication Data

US 2019/0210298 A1 Jul. 11, 2019

(30) Foreign Application Priority Data

Sep. 16, 2016 (JP) ..... JP2016-182138

(51) Int. Cl.
*B65B 1/32* (2006.01)
*B65B 59/04* (2006.01)
(Continued)

(52) U.S. Cl.
CPC ..... *B65B 1/32* (2013.01); *B65B 9/22* (2013.01); *B65B 57/005* (2013.01); *B65B 59/04* (2013.01); *B65B 37/18* (2013.01)

(58) Field of Classification Search
CPC .... B65B 1/32; B65B 9/20; B65B 9/22; B65B 37/18; B65B 57/005; B65B 59/04
(Continued)

(56) References Cited

U.S. PATENT DOCUMENTS 7,124,559 B2 * 10/2006 Taylor ..... B65B 9/22 53/551
7,802,698 B2 * 9/2010 Taylor et al. ..... B65B 9/20 221/210
(Continued)

FOREIGN PATENT DOCUMENTS

DE 102011118592 A1 * 5/2013 ..... B65B 59/04
DE 202015106885 U1 1/2016
(Continued)

OTHER PUBLICATIONS

International Search Report issued in PCT/JP2017/029644; dated Oct. 17, 2017.
(Continued)

*Primary Examiner* — Stephen F. Gerrity
(74) *Attorney, Agent, or Firm* — Studebaker & Brackett PC

(57) ABSTRACT

A weighing and packaging apparatus (10) includes a packaging unit (14), a weighing unit (11), and a frame (70). The packaging unit (14) includes a film transport mechanism (30) that transports a film (F) in a film transport direction, a detachable former (22), a former seat (82) that supports the former (22), and a sealing mechanism (50). The weighing unit (11) is positioned on an upper side in a vertical direction of the packaging unit (14), and supplies articles (A) to be packaged to the packaging unit (14). The frame (70) supports at least the weighing unit (11), and includes legs including a first front leg (71*a*), a first back leg (71*b*), a second front leg (72*a*), and a second back leg (72*b*). A movable portion (89) including the former seat (82) moves
(Continued)

in a maintenance mechanism movable space (PM) when the former (22) is detached. All of the legs are located so as to avoid a leg prohibited space (PP).

10 Claims, 13 Drawing Sheets

(51) Int. Cl.
*B65B 9/22* (2006.01)
*B65B 57/00* (2006.01)
*B65B 37/18* (2006.01)

(58) Field of Classification Search
USPC ..... 53/502, 551, 167
See application file for complete search history.

(56) References Cited

U.S. PATENT DOCUMENTS

| | | | | |
|---|---|---|---|---|
| 8,522,516 | B2 * | 9/2013 | Ichikawa et al. | B65B 59/04 53/551 |
| 2002/0073660 | A1 * | 6/2002 | Fukuda | B65B 51/306 53/551 |
| 2004/0088948 | A1 * | 5/2004 | Yamamoto et al. | B65B 9/207 53/551 |
| 2005/0016125 | A1 * | 1/2005 | Kinigakis et al. | B65B 9/20 53/551 |
| 2010/0037568 | A1 * | 2/2010 | Hashimoto et al. | B65B 59/04 53/551 |
| 2012/0198799 | A1 * | 8/2012 | Nishitsuji et al. | B65B 9/22 53/551 |
| 2012/0285129 | A1 * | 11/2012 | Kamigaito et al. | B65B 9/22 53/548 |

FOREIGN PATENT DOCUMENTS

| | | | | |
|---|---|---|---|---|
| EP | 1495967 | A1 | 1/2005 | |
| EP | 2138403 | A1 | 12/2009 | |
| EP | 2522585 | A1 | 11/2012 | |
| JP | 4707441 | B2 | 6/2011 | |
| JP | 2013-230842 | A | 11/2013 | |
| JP | 2015-519264 | A | 7/2015 | |
| JP | 2015-178368 | A | 10/2015 | |
| WO | WO-03068605 | A1 * | 8/2003 | B65B 9/20 |
| WO | WO-2008132942 | A1 * | 11/2008 | B65B 59/04 |

OTHER PUBLICATIONS

International Preliminary Report on Patentability and Written Opinion issued in PCT/JP2017/029644; dated Mar. 19, 2019.

The extended European search report issued by the European Patent Office dated Jun. 27, 2019, which corresponds to European Patent Application No. 17850627.5 and is related to U.S. Appl. No. 16/334,294.

* cited by examiner

WEIGHING AND PACKAGING APPARATUS

TECHNICAL FIELD

The present invention relates to a weighing and packaging apparatus.

BACKGROUND ART

Articles such as snack food are packaged in bags and then shipped as products. In order to manufacture such products, a weighing and packaging apparatus such as that described in Patent Literature 1 (Japanese Patent No. 4707441) is used. Weighing and packaging apparatuses are apparatuses that combine a combination weighing machine and a bag making and packaging machine. Combination weighing machines separate set amounts of articles. Bag making and packaging machines package the set amounts of articles that have been separated. The bag making and packaging machine is disposed below the combination weighing machine. The bag making and packaging machine receives the articles dropped from the combination weighing machine, packages the articles in a bag, and discharges a finished product.

The bag making and packaging machine includes a former that deforms a film into a cylindrical shape. When using a weighing and packaging apparatus to manufacture various products, the specifications of the bags to be manufactured are changed by product. When changing the specifications, the former that determines the shape of the bag must be replaced.

SUMMARY OF THE INVENTION

Technical Problem

Combination weighing machines and bag making and packaging machines are, in general, large machines, and a frame is typically used in conjunction with the machines to support the machines. A plurality of leg portions constituting the frame are erected to at least the height of the bag making and packaging machine. In many cases, these leg portions restrict the movement of workers who replace the former, clean the former, and perform other maintenance.

An object of the present invention is to ensure a degree of freedom in the work a worker performs on a weighing and packaging apparatus.

Solutions to Problems

A weighing and packaging apparatus according to a first aspect of the present invention includes a bag making and packaging unit, a weighing unit, and a frame. The bag making and packaging unit includes a film transport mechanism that transports a film in a film transport direction, a detachable former, a former seat that supports the former, and a sealing mechanism. The weighing unit is positioned on an upper side in a vertical direction of the bag making and packaging unit, and supplies articles to be packaged to the bag making and packaging unit. The frame supports at least the weighing unit, and includes a plurality of leg portions. A movable portion including the former seat moves in a maintenance mechanism movable space when the former is detached. All of the plurality of leg portions are located so as to avoid a predetermined leg prohibited space.

According to this configuration, all of the leg portions are located so as to avoid the leg prohibited space. The leg prohibited space is a location that is important to the worker when performing the work of replacing the former. Accordingly, a degree of freedom in the maintenance work the worker performs is ensured.

A weighing and packaging apparatus according to a second aspect of the present invention is the weighing and packaging apparatus according to the first aspect, wherein a film width direction is orthogonal to a plane that includes the film transport direction. The leg prohibited space includes the maintenance mechanism movable space and lateral space. The lateral space is adjacent to one side in the film width direction of the maintenance mechanism movable space.

According to this configuration, the leg prohibited space includes the lateral space that is adjacent to the maintenance mechanism movable space. Accordingly, it is easier for the worker to replace the former while standing beside the former.

A weighing and packaging apparatus according to a third aspect of the present invention is the weighing and packaging apparatus according to the second aspect, further including a film feed portion that receives the film, and a packaged product discharge portion that discharges a product that is packaged. A front side is a side, in a front-back direction perpendicular to both the vertical direction and film width direction, of the packaged product discharge portion. A back side is a side, in the front-back direction, of the film feed portion. A center plane that divides in the film width direction divides a first region that includes the lateral space and a second region that does not include the lateral space. The plurality of leg portions includes first leg portions that are disposed in the first region and second leg portions that are disposed in the second region. All of the first leg portions are disposed farther to the back side than the lateral space.

According to this configuration, there are no leg portions on the front side of the lateral space. Accordingly, the worker can utilize the space on the front side where there are no obstacles and, therefore, a degree of freedom in the maintenance work the worker performs is ensured.

A weighing and packaging apparatus according to a fourth aspect of the present invention is the weighing and packaging apparatus according to the second aspect, further including a film feed portion that receives the film, and a packaged product discharge portion that discharges a product that is packaged. A front side is a side, in a front-back direction perpendicular to both the vertical direction and film width direction, of the packaged product discharge portion. At least one of the plurality of leg portions is disposed farther to the front side than the lateral space.

According to this configuration, the plurality of leg portions are disposed with a wide space therebetween so as to sandwich the lateral space. Accordingly, the frame is stably installed.

A weighing and packaging apparatus according to a fifth aspect of the present invention is the weighing and packaging apparatus according to the fourth aspect, wherein a separation distance in the front-back direction from an end on the front side of the sealing mechanism to a leg on the front side is from 300 mm to 800 mm.

According to this configuration, the worker can move in the space formed by the large separation distance between the sealing mechanism and the leg. Accordingly, a greater degree of freedom in the maintenance work the worker performs is ensured.

A weighing and packaging apparatus according to a sixth aspect of the present invention is the weighing and packaging apparatus according to the fifth aspect, wherein the separation distance is from 400 mm to 600 mm.

According to this configuration, the worker can move in the large space and the outer dimensions of the weighing and packaging apparatus can be suitably suppressed. Accordingly, the installation area of the weighing and packaging apparatus can be reduced.

A weighing and packaging apparatus according to a seventh aspect of the present invention is the weighing and packaging apparatus according to any one of the fourth to sixth aspects, further including a safety door that is openable and closeable and that has a width extending in the front-back direction. A worker can, at least partially, enter a space surrounded by the safety door and the plurality of leg portions.

According to this configuration, the worker can, at least partially, enter the space inside the safety door. Accordingly, the maintenance work of the worker is facilitated. Furthermore, if the safety door is linked to the switch for shutting down the weighing and packaging apparatus, the safety of the worker working in the internal space is ensured.

A weighing and packaging apparatus according to an eighth aspect of the present invention is the weighing and packaging apparatus according to any one of the third to seventh aspects, wherein the movable portion moves in the maintenance mechanism movable space in directions within a horizontal plane, including the front-back direction and the film width direction.

According to this configuration, the movable portion moves within the horizontal plane. Accordingly, when replacing the former, the worker does not need to significantly change posture.

A weighing and packaging apparatus according to a ninth aspect of the present invention is the weighing and packaging apparatus according to the eighth aspect, wherein the movable portion turns in an arc-like manner within the horizontal plane.

According to this configuration, the movable portion moves by turning from an operating position to a work position. Accordingly, the structure of the movable portion can be simplified.

A weighing and packaging apparatus according to a tenth aspect of the present invention is the weighing and packaging apparatus according to any one of the first to ninth aspects, wherein the frame further supports the bag making and packaging unit.

According to this configuration, the frame supports the bag making and packaging unit. Accordingly, the overall durability of the weighing and packaging apparatus is improved.

Advantageous Effects of the Invention

With the weighing and packaging apparatus according to the present invention, a degree of freedom in the work a worker performs is ensured.

DESCRIPTION OF EMBODIMENTS

Next, embodiments of the present invention will be described with reference to the drawings. Note that the following embodiments are merely examples of the present invention and should not be construed as limiting the technical scope of the present invention.

(1) Overall Configuration

Figure 1:
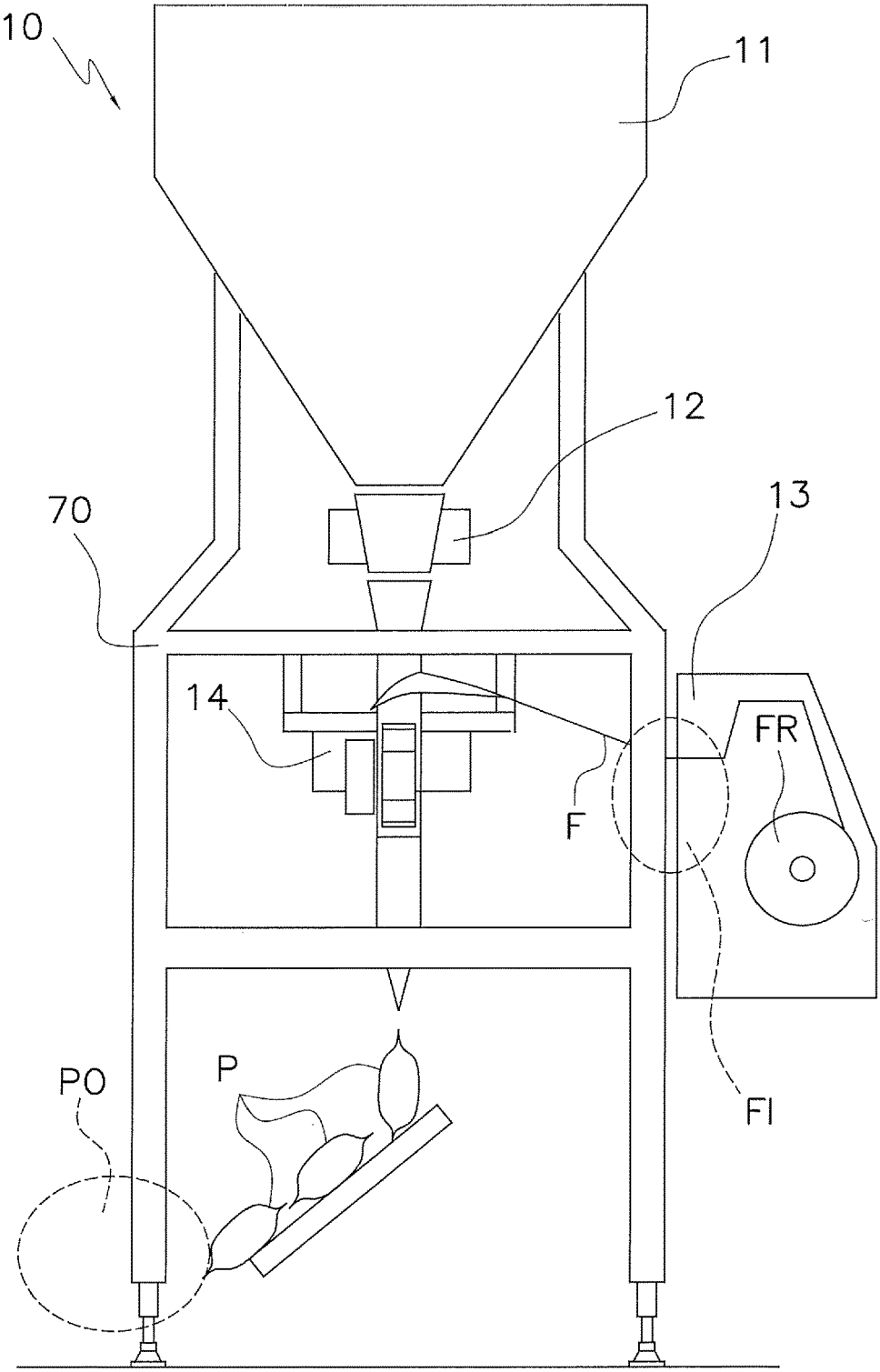
FIG. 1 is a schematic drawing of a weighing and packaging apparatus 10 according to an embodiment of the present invention.

FIG. 1 illustrates a weighing and packaging apparatus 10 according to an embodiment of the present invention. The weighing and packaging apparatus 10 packages a predetermined amount of articles, such as snack food, in a bag made from a film F to manufacture a product P in a distributable form. The weighing and packaging apparatus 10 includes a weighing unit 11, an inspection unit 12, a film supplying unit 13, a packaging unit 14, and a frame 70. The inspection unit 12 is disposed below the weighing unit 11. The packaging unit 14 is disposed below the inspection unit 12. The film supplying unit 13 is disposed adjacent to the packaging unit 14. The film F is fed into the packaging unit 14 through a film feed portion FI. The packaged product P is discharged through a packaged product discharge portion PO.

(2) Detailed Configuration (2-1) Weighing Unit 11

Figure 2:
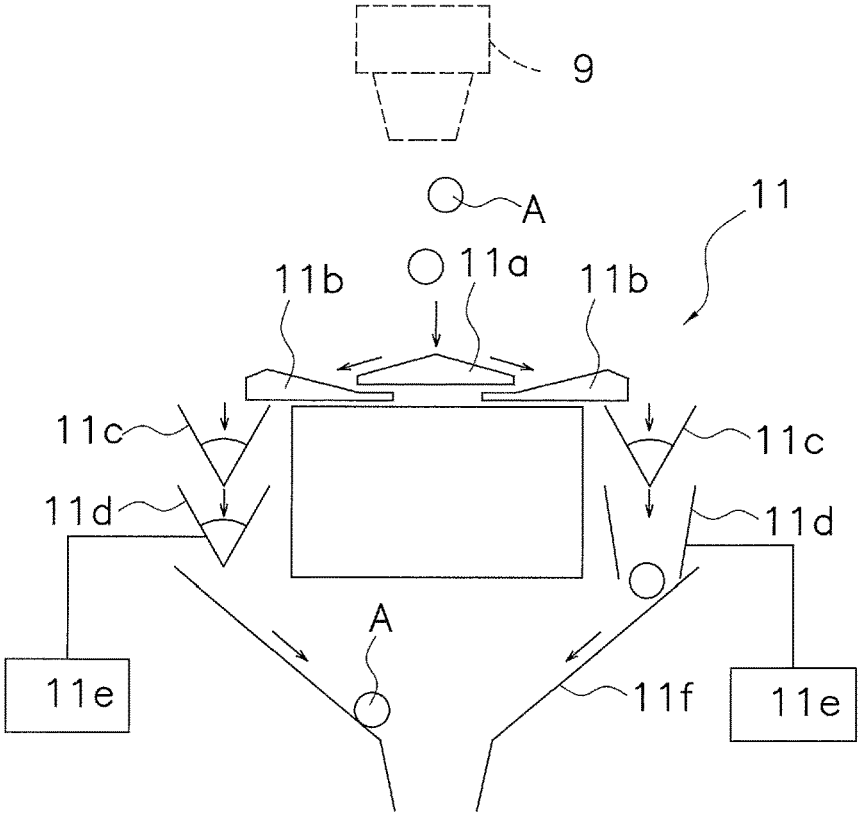
FIG. 2 is a schematic drawing of a weighing unit 11.

FIG. 2 illustrates a configuration of the weighing unit 11. The weighing unit 11 is constituted by a combination weighing machine. The weighing unit 11 weighs articles A, and supplies a predetermined amount of the articles A to a next stage. The weighing unit 11 includes a dispersion feeder 11*a*, a plurality of troughs 11*b*, a plurality of pool hoppers 11*c*, a plurality of weighing hoppers 11*d*, a plurality of mass sensors 11*e*, and a collection chute 11*f*. The arrows indicate the movement of the articles A.

The articles A are supplied from an article supply apparatus 9 disposed above the weighing unit 11. The articles A fall on a center portion of the dispersion feeder 11*a*. The articles A on the dispersion feeder 11*a* are radially dispersed by the action of a vibration device (not illustrated in the drawings) located in the dispersion feeder 11*a*, and move to the plurality of troughs 11*b*. The action of a vibration device (not illustrated in the drawings) located in each trough 11*b* causes the articles A on that trough 11*b* to move to the pool hopper 11*c* installed corresponding to that trough 11*b*.

The number of pool hoppers 11*c* corresponds to the number of troughs 11*b*. The pool hoppers 11*c* are containers that temporarily store the articles A. Each pool hopper 11*c* includes an openable-closeable shutter. When the shutter is open, the articles A in the pool hopper 11*c* fall and enter the weighing hopper 11*d* installed corresponding to that pool hopper 11*c*.

The number of weighing hoppers 11*d* corresponds to the number of pool hoppers 11*c*. The weighing hoppers 11*d* are devices that weigh the articles A. Each weighing hopper 11*d* includes a mass sensor 11*e* and an openable-closeable shutter. The mass sensor 11*e* measures the mass of the articles A in the weighing hopper 11*d* and sends the measurement results to a control circuit (not illustrated in the drawings). In one example, the mass sensors 11*e* are constituted from load cells. The control circuit ascertains the mass of the articles A stored in each of the plurality of weighing hoppers 11*d*. The control circuit subsequently determines the combination of the weighing hoppers 11*d* that will result in a mass nearest to the predetermined amount. The control circuit subsequently opens only the shutters of the weighing hoppers 11*d* of that combination. When the shutters are open, the articles A in the weighing hoppers 11*d* fall and move to the collection chute 11*f*. The collection chute 11*f* moves all of the articles A that fall from the plurality of weighing hoppers 11*d* to the inspection unit 12.

(2-2) Inspection Unit 12

Figure 3:
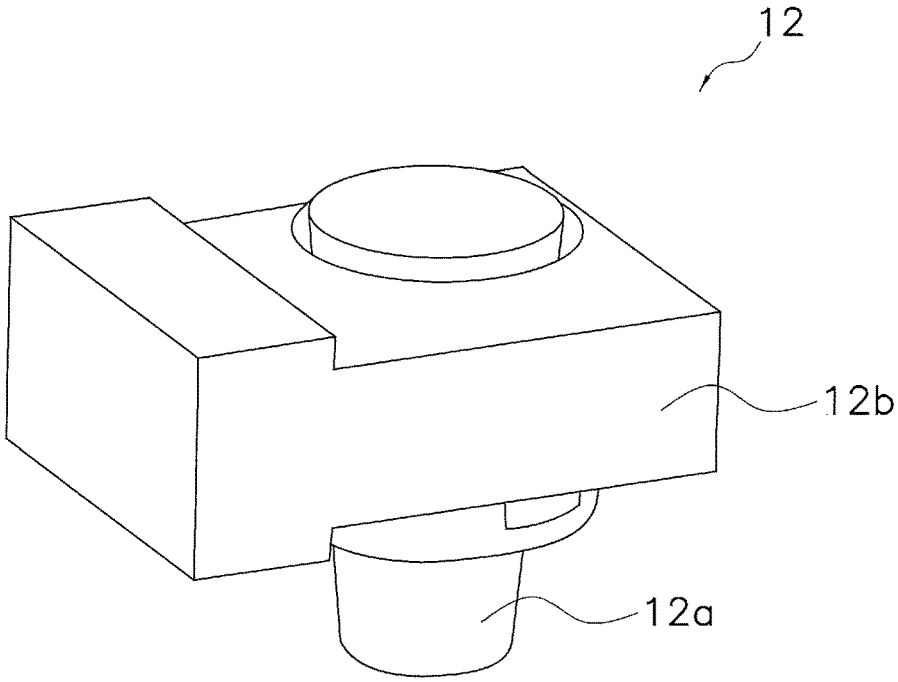
FIG. 3 is a schematic drawing of an inspection unit 12.

FIG. 3 illustrates a configuration of the inspection unit 12. The inspection unit 12 detects foreign objects mixed in with the articles A. The inspection unit 12 includes an inspection chute 12*a* and a metal detection unit 12*b*. The inspection chute 12*a* is a cylinder with a tapered shape, and functions as a passageway for the articles A. The metal detection unit 12*b* detects metal foreign matter mixed in with the articles A that are passing through the inspection chute 12*a*. When foreign matter is detected, the metal detection unit 12*b* sends a foreign matter detection signal to the control circuit. The control circuit causes the packaging unit 14 or the like to perform an appropriate disposal process to ensure that the articles A contaminated with foreign matter are not used.

(2-3) Film Supplying Unit 13

The film supplying unit 13 illustrated in FIG. 1 supplies the film F, which becomes the material of the bag, to the packaging unit 14. The film supplying unit 13 holds a film roll FR. The film supplying unit 13 actively or passively transports the film F wound on the film roll FR to the packaging unit 14.

(2-4) Packaging Unit 14

Figure 4:
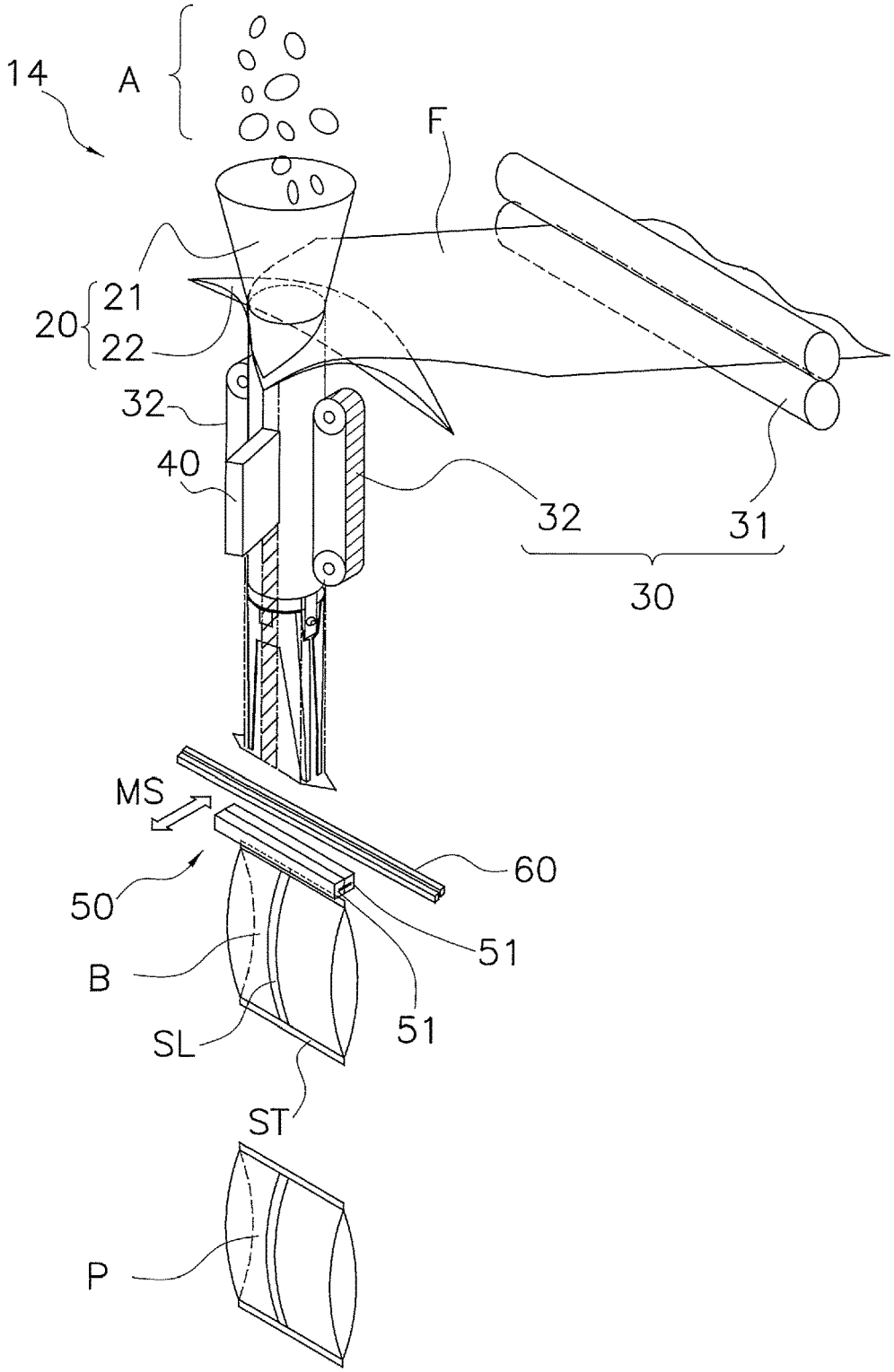
FIG. 4 is a schematic drawing illustrating the structure of a packaging unit 14.

FIG. 4 illustrates the configuration of the packaging unit 14. The packaging unit 14 is constituted by a bag making and packaging machine. The packaging unit 14 forms a bag B from the film F, and packages, in the bag B, the predetermined amount of articles A received from the weighing unit 11. Thereafter, the packaging unit 14 discharges the packaged product P. The packaging unit 14 includes a film shaping mechanism 20, a film transport mechanism 30, a vertical sealing mechanism 40, a lateral sealing mechanism 50, a shutter mechanism 60, and a maintenance mechanism 80 (not illustrated in the drawings).

(2-4-1) Film Shaping Mechanism 20

The film shaping mechanism 20 forms a certain shape with the planar film F. The film shaping mechanism 20 includes an article guide 21 and a former 22. The article guide 21 forms the bag B while holding the film F in a cylinder shape, and guides the predetermined amount of articles A discharged from the weighing unit 11 into the bag B. The article guide 21 is a cylindrical tube and includes a funnel-shaped upper end for receiving the articles A. The article guide 21 is replaced with components of different shapes depending on the type of the product P. The former 22 cooperates with the article guide 21 to guide the film F so that the planar film F is deformed into a cylindrical shape. The former 22 is also replaced with components of different shapes depending on the type of the product P.

(2-4-2) Film Transport Mechanism 30

The film transport mechanism 30 transports the material of the bag B, namely the film F. The film transport mechanism 30 includes rollers 31 and a pulldown belt 32. The rollers 31 receive the film F and send it to the film shaping mechanism 20. The pulldown belt 32 is driven by a motor (not illustrated in the drawings) to transport the cylindrical film F downward along the article guide 21.

(2-4-3) Vertical Sealing Mechanism 40

The vertical sealing mechanism 40 bonds the two sides of the film F extending in the transport direction to form the film F into a cylinder. The vertical sealing mechanism 40 presses and heats the two sides of the film F that are overlapped on the article guide 21. The vertical sealing mechanism 40 includes, for example, a heater and a heater belt. The site bonded by the vertical sealing mechanism 40 serves as a vertical seal portion SL of the bag B.

(2-4-4) Lateral Sealing Mechanism 50

The lateral sealing mechanism 50 is a device that bonds the two opposing surfaces of the cylindrical film F to create the bag B. The lateral sealing mechanism 50 includes a pair of sealing jaws 51. The sealing jaws 51 are each able to reciprocate in the horizontal direction indicated by arrow MS so as to approach and separate from each other. A heater and a movable knife (not illustrated in the drawings) are embedded in the sealing jaws 51.

The transportation of the cylindrical film F is temporarily stopped while the lateral sealing mechanism 50 is executing a lateral sealing process. The sealing jaws 51 approach each other to press the two opposing surfaces of the cylindrical film F. The pressed two surfaces are heated and bonded due to the movement of the heater. The site bonded by the lateral sealing mechanism 50 serves as a lateral seal portion ST of the bag B. Finally, the movable knife cuts the lateral seal portion ST. The cut lateral seal portion ST becomes the upper end of one and the lower end the other of two adjacent bags B. After the lateral sealing process described above is completed, the sealing jaws 51 are separated from each other. Then, the transportation of the cylindrical film F is restarted.

The lateral sealing mechanism 50 may include a pair of sealing jaws connected to an arm that is attached to a rotational shaft instead of the pair of sealing jaws 51 that reciprocate in the horizontal direction. In such a case, the sealing jaws 51 can move downward at the same speed as the transportation speed of the film F while revolving around the rotation shaft. This configuration eliminates the need to stop the transportation of the film F during the lateral sealing process.

(2-4-5) Shutter Mechanism 60

The shutter mechanism 60 is installed above the lateral sealing mechanism 50. The shutter mechanism 60 prevents the articles A from reaching the lateral sealing mechanism 50 by pressing the two opposing surfaces of the cylindrical film F before the lateral sealing mechanism 50 begins the lateral sealing process. As a result, the shutter mechanism 60 prevents the articles A from being sandwiched between the two opposing surfaces of the film M that the lateral sealing mechanism 50 bonds.

(2-4-6) Maintenance Mechanism 80

The maintenance mechanism 80 will be described later.

(2-5) Frame 70

Figure 5:
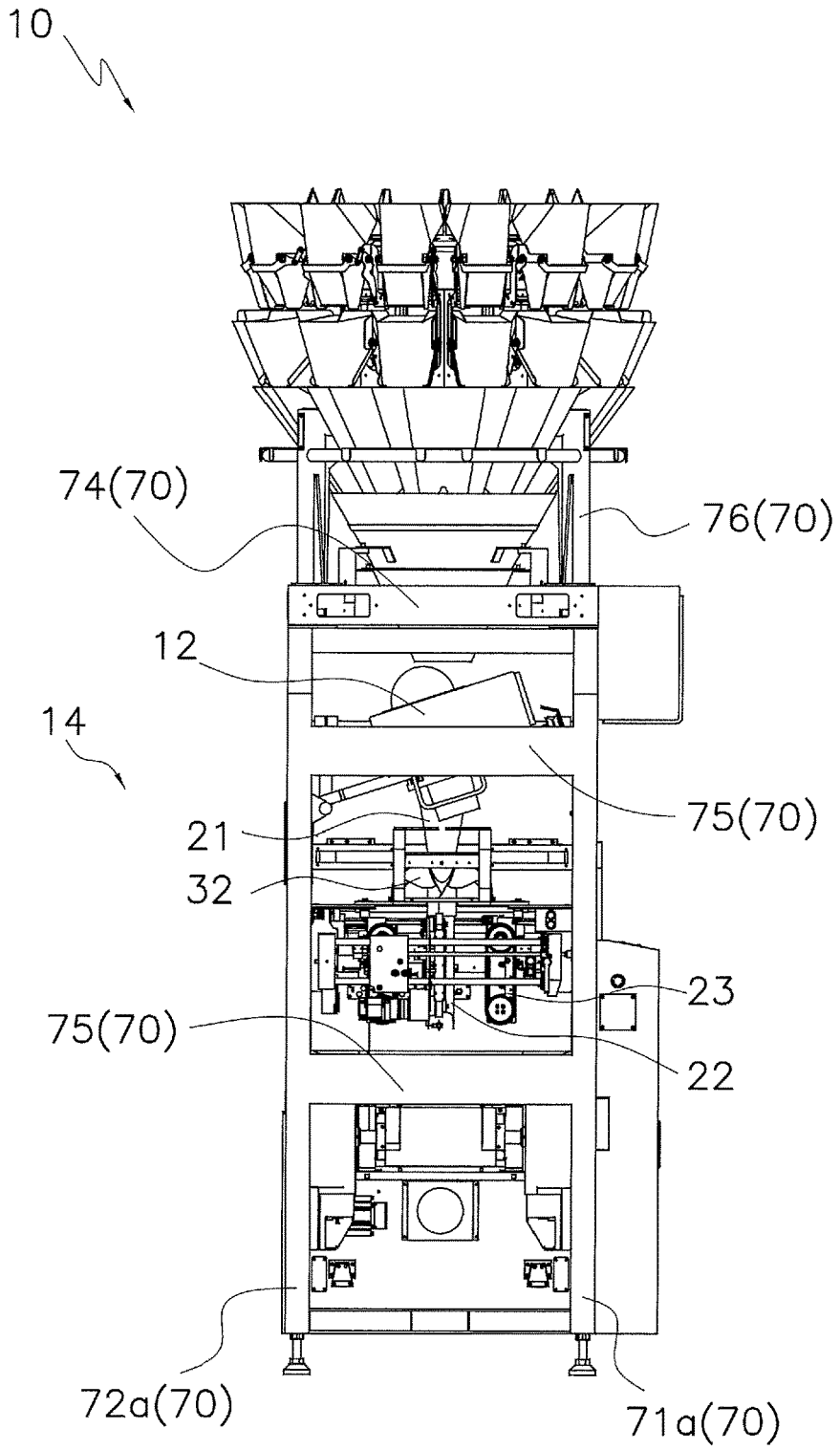
FIG. 5 is a front view illustrating the appearance of the weighing and packaging apparatus 10 according to an embodiment of the present invention.
Figure 6:
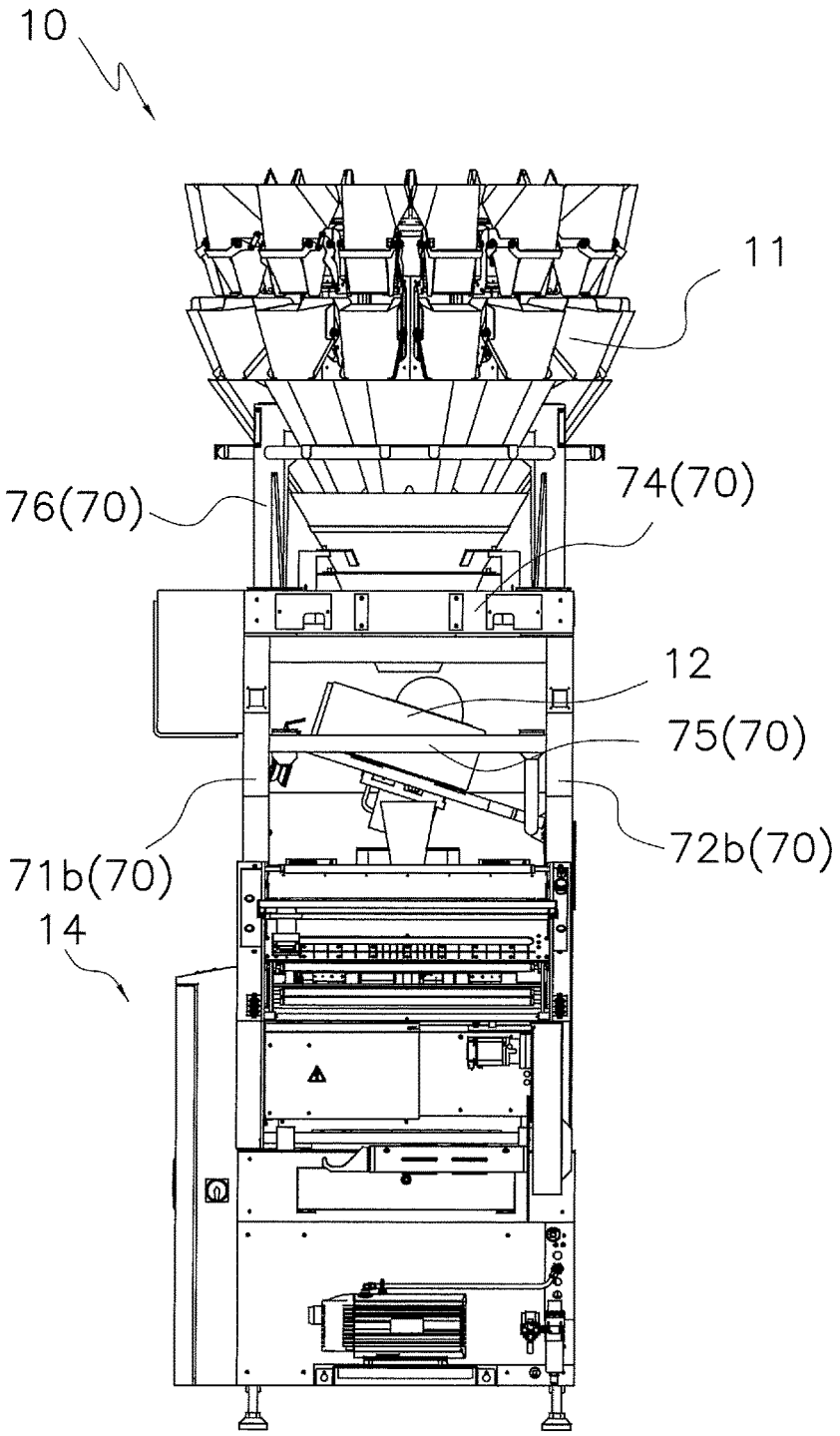
FIG. 6 is a back view illustrating the appearance of the weighing and packaging apparatus 10 according to an embodiment of the present invention.
Figure 7:
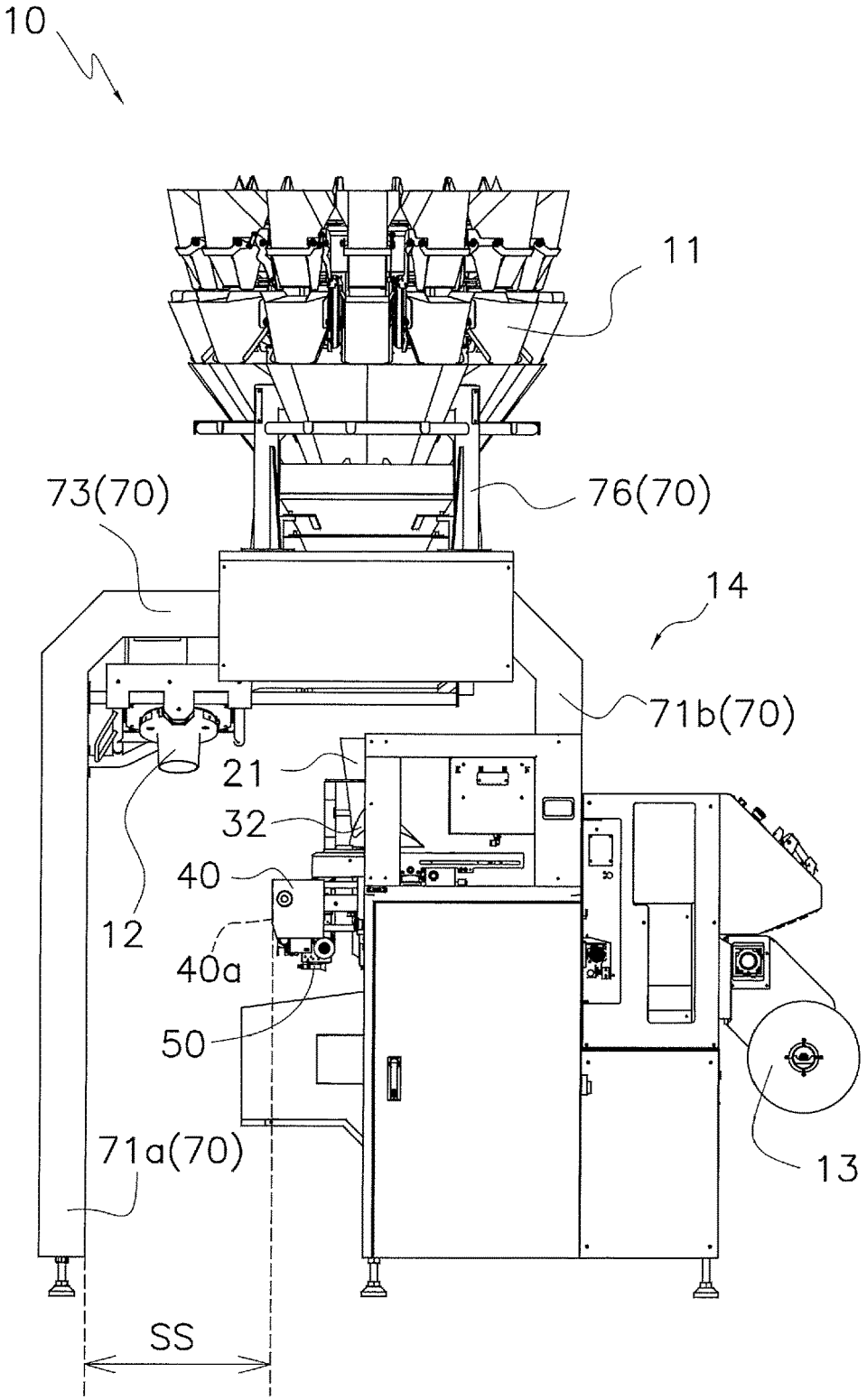
FIG. 7 is a side view illustrating the appearance of the weighing and packaging apparatus 10 according to an embodiment of the present invention.

FIGS. 5, 6, and 7 illustrate an appearance of the weighing and packaging apparatus 10. Note that, in these drawings, the inspection unit 12 is moved from the position during operation in order to perform maintenance work. The frame 70 illustrated in the front view of FIG. 5 directly or indirectly supports the weighing unit 11, the packaging unit 14, and other constituents. The frame 70 includes a first front leg 71*a*, a second front leg 72*a*, an upper beam 74, and a plurality of lower beams 75. The upper beam 74 connects an upper end of the first front leg 71*a* to an upper end of the second front leg 72*a*. The plurality of lower beams 75 connect the approximate middle of the first front leg 71*a* to the approximate middle of the second front leg 72*a*.

As illustrated in the back view of FIG. 6, the frame 70 also includes a first back leg 71*b* and a second back leg 72*b*. A separate upper beam 74 connects an upper end of the first back leg 71*b* to an upper end of the second back leg 72*b*. Separate lower beams 75 connect the approximate middle of the first front leg 71*a* to the approximate middle of the second front leg 72*a*.

As illustrated in the side view of FIG. 7, the frame 70 also includes a crossbeam 73 and a support portion 76. The crossbeam 73 connects the upper end of the first front leg 71*a* to the upper end of the first back leg 71*b*. While not illustrated in FIG. 7, a separate crossbeam 73 connects the upper end of the second front leg 72*a* to the upper end of the second back leg 72*b*. The support portion 76 is fixed to the crossbeam 73 and supports the weighing unit 11. In the sealing mechanism including the vertical sealing mechanism 40 and the lateral sealing mechanism 50, an end portion 40*a* near the first front leg 71*a* is positioned on the vertical sealing mechanism 40 in this configuration. A separation distance SS from the end portion 40*a* of the sealing mechanism near the first front leg 71*a* to the first front leg 71*a* is from 300 mm to 800 mm. The separation distance SS is preferably from 400 mm to 600 mm.

(3) Maintenance Work (3-1) Structure of Maintenance Mechanism 80

Figure 8:
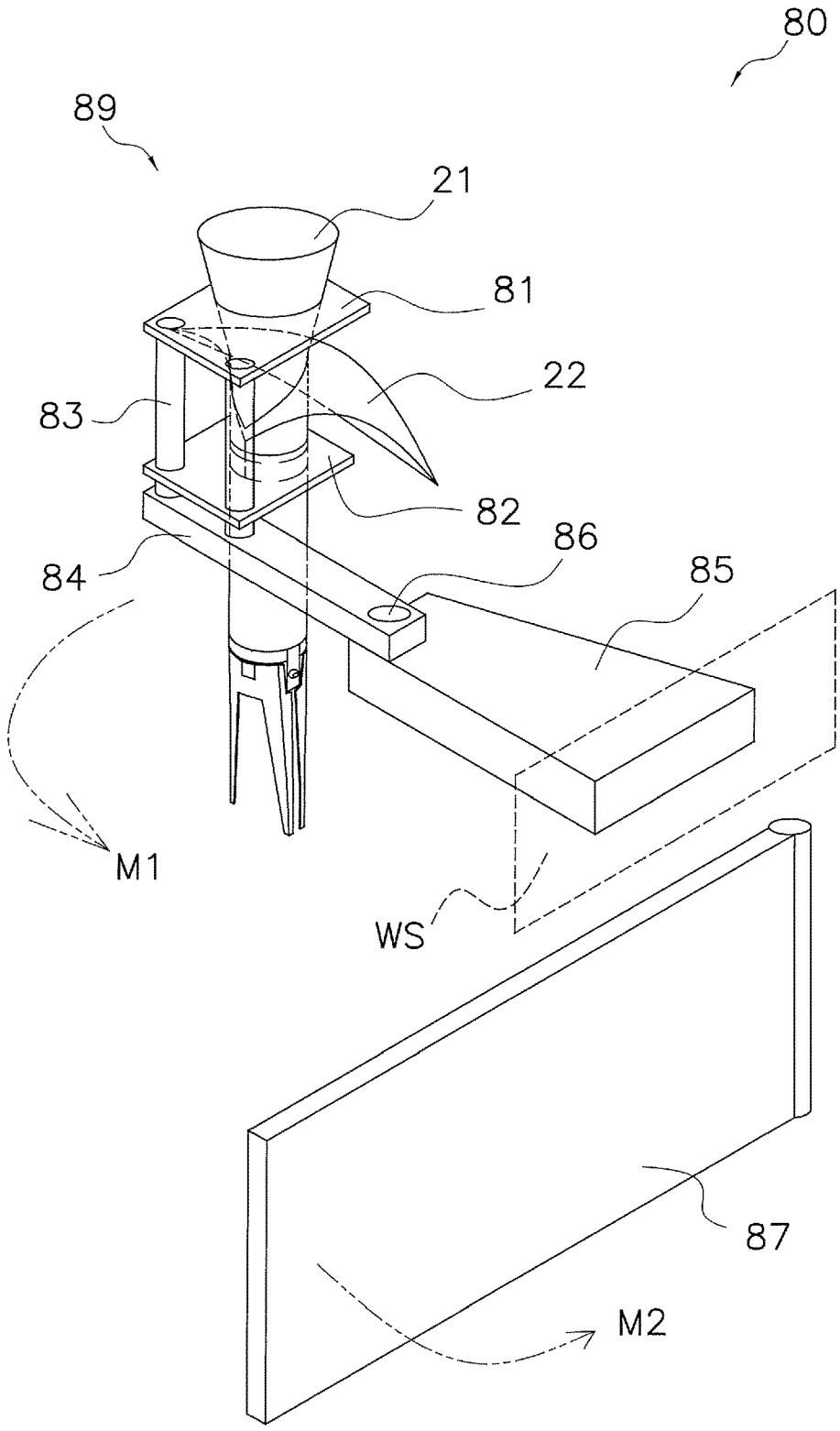
FIG. 8 is a schematic drawing illustrating the structure of a maintenance mechanism 80.

Next, the maintenance mechanism 80 of the packaging unit 14 is described. FIG. 8 illustrates the structure of the maintenance mechanism 80. The maintenance mechanism 80 facilitates maintenance work performed by a worker. Here, the term "maintenance work" includes the work of removing the article guide 21 and the former 22 in order to clean, and the work of replacing the article guide 21 and the former 22 depending on the type of the product P. The maintenance mechanism 80 includes an article guide seat 81, a former seat 82, a coupling rod 83, a movable bar 84, a base 85, and a joint portion 86. Of these constituents, the article guide seat 81, the former seat 82, the coupling rod 83, and the movable bar 84 form a movable portion 89.

The article guide seat 81 detachably supports the article guide 21. The former seat 82 detachably supports the former 22. The coupling rod 83 connects the article guide seat 81 and the former seat 82 to the movable bar 84. The movable bar 84 is connected to the base 85 via the joint portion 86. The base 85 is directly connected to the frame 70 or indirectly connected to the frame 70 via a separate member. The movable portion 89 can turn, as illustrated by the arrow M1, about the joint portion 86.

A work surface WS is a surface defined by the first front leg 71*a*, the first back leg 71*b*, and the crossbeam 73 that connects the first front leg 71*a* to the first back leg 71*b* of the frame 70. The work surface WS is the same as or adjacent to one surface of the base 85. The movable portion 89 illustrated in FIG. 8 is disposed at the position that the movable portion 89 assumes at a time of operation of the packaging unit 14 and, in this specification, this position is referred to as the "operating position." In this specification, the position where the movable portion 89 turns in the direction of the arrow M1 and has approached the work surface WS, is referred to as the "work position."

The maintenance mechanism 80 may further include a safety door 87 disposed on the work surface WS. A shutdown switch is located on the safety door 87. The safety of the worker can be ensured by configuring such that the shutdown switch stops the various functions of the weighing and packaging apparatus 10 when the safety door 87 is opened in the direction indicated by arrow M2.

(3-2) Positions of Workers

Figure 9:
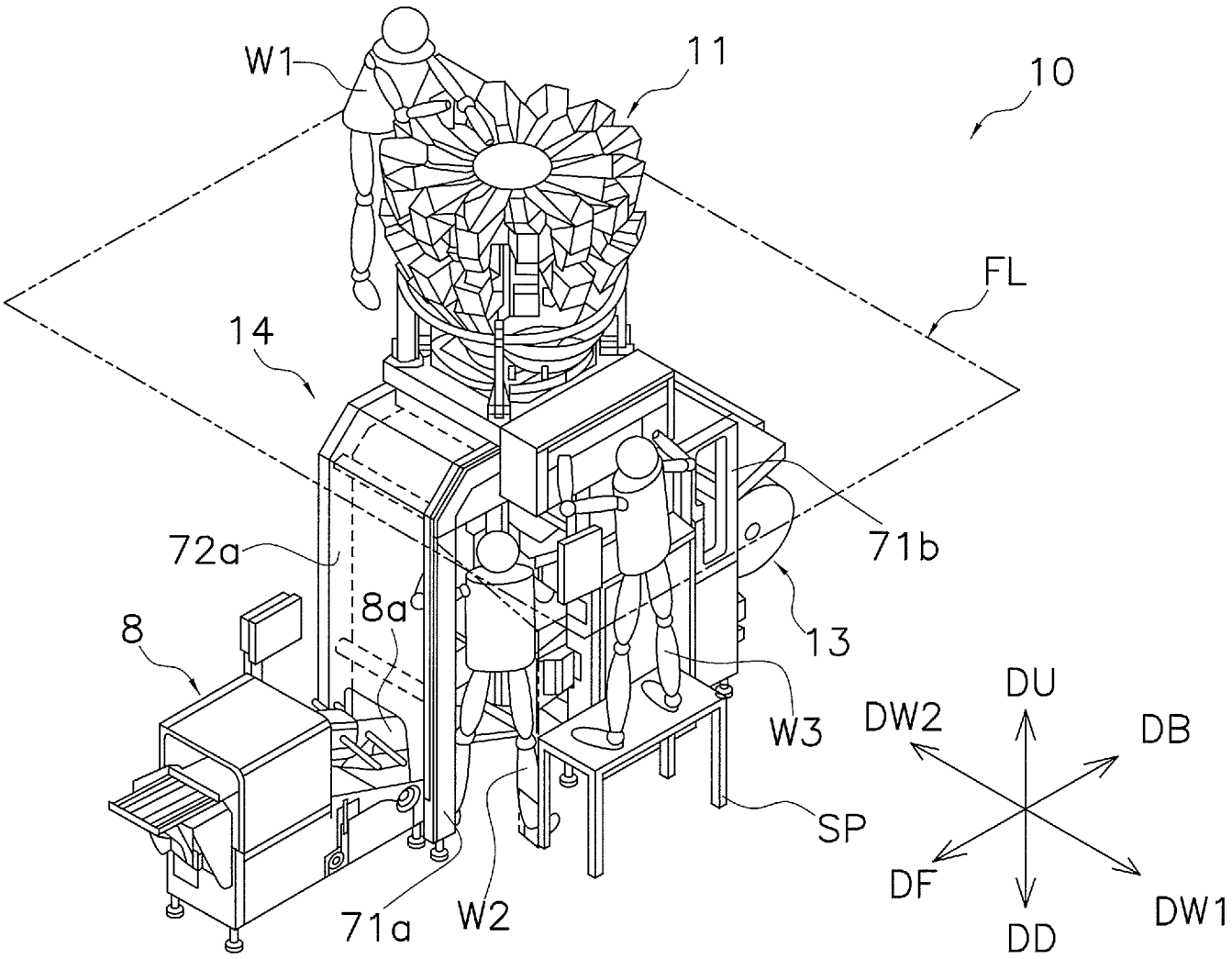
FIG. 9 is a perspective view illustrating the appearance of the weighing and packaging apparatus 10 according to an embodiment of the present invention.

FIG. 9 illustrates workers W1 to W3 that are performing maintenance work on the weighing and packaging apparatus 10. In FIG. 9, six orthogonal directions, namely an upward direction DU, a downward direction DD, a frontward direction DF, a backward direction DB, a film width first direction DW1, and a film width second direction DW2, are defined.

The weighing unit 11 is disposed on the upward direction DU side of the work floor FL. The film supplying unit 13 and the packaging unit 14 are disposed on the downward direction DD side of the work floor FL. A discharge machine 8 is disposed on the frontward side DF of the packaging unit 14 so as to be adjacent to the first front leg 71*a* and the second front leg 72*a*. The discharge machine 8 discharges the product P manufactured by the packaging unit 14 and passes the product P to the subsequent process. A belt conveyor 8*a* of the discharge machine 8 is disposed so as to pass through the packaged product discharge portion PO (FIG. 1). The film supplying unit 13 is disposed on the backward direction DB side of the packaging unit 14.

The worker W1 is performing maintenance work on the weighing unit 11 on the work floor FL. The worker W2 has entered inside the frame 70 beyond the work surface WS and is performing maintenance work on the packaging unit 14 beneath the work floor FL. In the maintenance work of the packaging unit 14, the worker W2 performs work such as detaching the article guide 21 and the former 22. The worker W3 is standing on a platform SP placed adjacent to the work surface WS and is performing maintenance on the control panel of the weighing and packaging apparatus 10 beneath the work floor FL.

It is difficult for the worker W2 to work in the space inside the frame 70. This is because there is very little standing room due to the presence of the belt conveyor 8*a*, which extends to below the packaging machine 3, at the feet of the worker W2. In a conventional weighing and packaging apparatus 10 that does not include the maintenance mechanism 80, the worker W2 that detaches the former 22 must lean their upper body forward over the belt conveyor 8*a* while standing near the work surface WS. In contrast, with the weighing and packaging apparatus 10 including the maintenance mechanism 80 according to the present invention (illustrated in FIG. 8), the movable portion 89 is disposed at the work position and, as such, the former 22 is proximal to or reaches the work surface WS. Accordingly, the need for the worker W2 to enter inside the frame 70 beyond the work surface WS is eliminated and the need to assume unstable postures such as leaning their upper body forward is also eliminated.

(3-3) Arrangement of Legs of Frame 70

Figure 10:
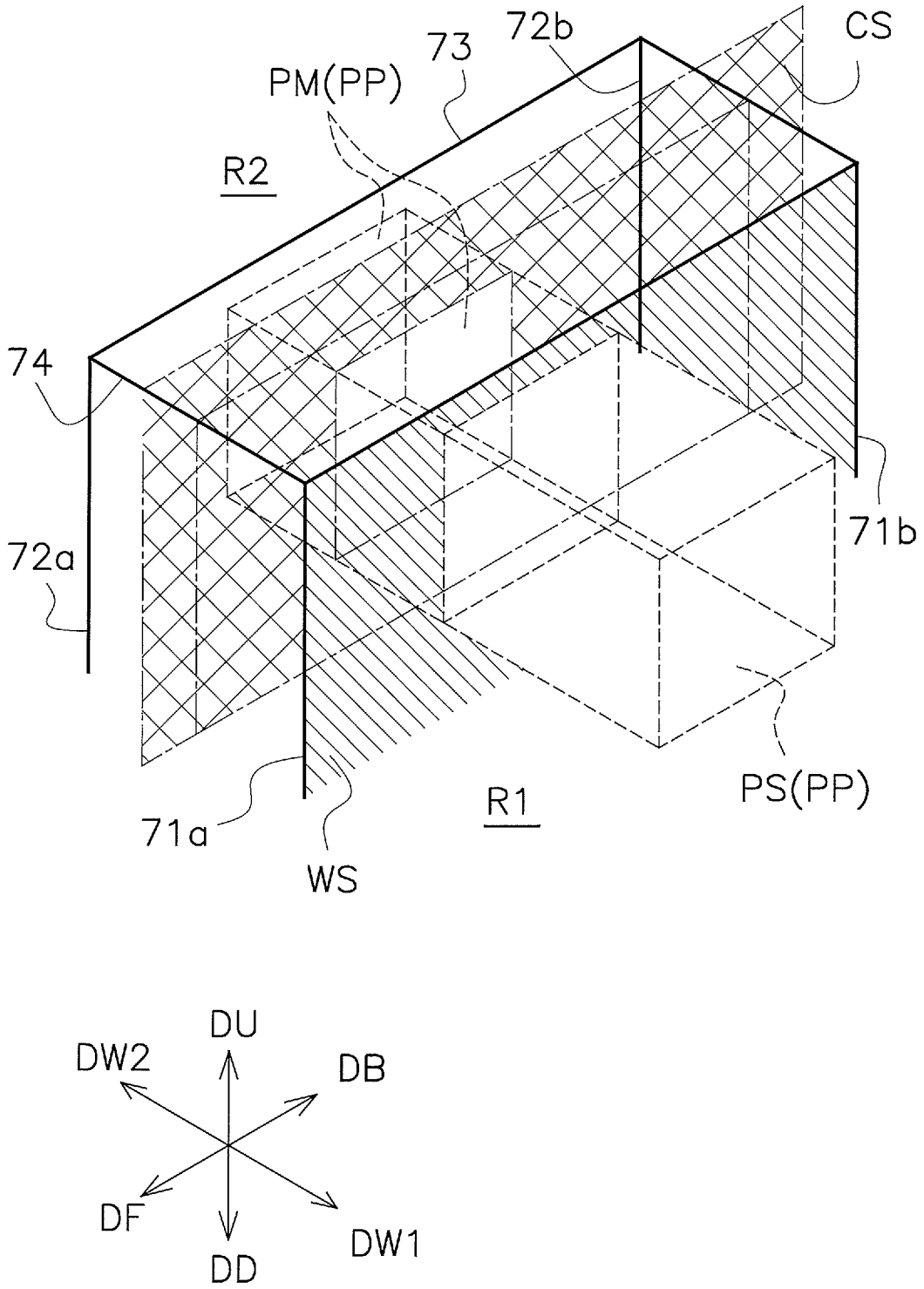
FIG. 10 is a schematic drawing illustrating the structure of a frame 70 of the weighing and packaging apparatus 10 according to an embodiment of the present invention.

FIG. 10 is a schematic drawing of the frame 70. As described above, the frame 70 includes the first front leg 71*a*, the second front leg 72*a*, the first back leg 71*b*, the second back leg 72*b*, the crossbeam 73, and the upper beam 74. The width of the film F expands in the film width direction, that is, the direction defined by the film width first direction DW1 and the film width second direction DW2. The upper beam 74 extends in the film width direction. Each of the legs extends in the vertical direction, that is, in the direction defined by the upward direction DU and the downward direction DD. The crossbeam 73 extends in the front-back direction, that is, in the direction defined by the frontward direction DF and the backward direction DB. The film F is transported in directions within the plane including the vertical direction and the front-back direction. Specifically, the film width direction is orthogonal to the plane including the film transport direction and, also, is perpendicular to both the vertical direction and the front-back direction.

As described above, the work surface WS is defined by the first front leg 71*a*, the first back leg 71*b*, and the crossbeam 73 that connects the first front leg 71*a* to the first back leg 71*b* of the frame 70.

The surface that bisects the film F in the film width direction is herein referred to as the "center plane CS." The center plane CS divides the space into a first region R1 and a second region R2. The legs of the frame 70 are divided into first legs that are disposed in the first region R1 and second legs that are disposed in the second region R2. The first legs include the first front leg 71*a* and the first back leg 71*b*. The second legs include the second front leg 72*a* and the second back leg 72*b*.

The movable portion 89 (FIG. 8) that includes the former seat 82 and other constituents moves in directions within the horizontal plane including the front-back direction and the film width direction and, specifically, moves in an arc-shape along the arrow M1 (FIG. 8). At this time, the movable portion 89 moves in maintenance mechanism movable space PM illustrated in FIG. 10. The maintenance mechanism movable space PM is positioned across both the first region R1 and the second region R2. When the maintenance mechanism 80 assumes the work position, the first region R1 is defined as the region in which the movable portion 89 is positioned. The work surface WS is positioned in the first region R1. The first region R1 includes lateral space PS that is adjacent to the maintenance mechanism movable space PM. The lateral space PS is outside the frame 70 and is proximal to the work surface WS.

In this specification, the maintenance mechanism movable space PM and the lateral space PS are collectively referred to as "leg prohibited space PP." All of the legs of the frame 70, namely the first front leg 71*a*, the second front leg 72*a*, the first back leg 71*b*, and the second back leg 72*b*, are disposed so as to avoid the leg prohibited space PP. The first front leg 71*a* is disposed on the frontward direction DF side of the leg prohibited space PP, thereby avoiding the leg prohibited space PP. The first back leg 71*b* is disposed on the backward direction DB side of the leg prohibited space PP, thereby avoiding the leg prohibited space PP.

(4) Features (4-1)

The first front leg 71*a*, the second front leg 72*a*, the first back leg 71*b*, and the second back leg 72*b* are each located so as to avoid the leg prohibited space PP. The leg prohibited space PP is a location that is important to the worker W2 when performing the work of replacing the former 22. Accordingly, a degree of freedom in the maintenance work the worker W2 performs is ensured.

(4-2)

The leg prohibited space PP includes the lateral space PS that is adjacent to the maintenance mechanism movable space PM. Accordingly, it is easier for the worker W2 to replace the former 22 while standing beside the former 22, that is, while standing outside the work surface WS.

(4-3)

The first front leg 71*a* and the first back leg 71*b* are disposed with a wide space therebetween so as to sandwich the lateral space PS. Accordingly, the frame 70 is stably installed.

(4-4)

A large separation distance SS of 300 mm to 800 mm or 400 mm to 600 mm is formed between the sealing mechanism and the first front leg 71*a*. The worker W2 can move in the space formed by the large separation distance SS. Accordingly, a greater degree of freedom in the maintenance work the worker W2 performs is ensured.

(4-5)

The worker W2 can, at least partially, enter the space inside the safety door 87. Accordingly, the maintenance work of the worker W2 is facilitated. Furthermore, if the safety door 87 is linked to the switch for shutting down the weighing and packaging apparatus 10, the safety of the worker W2 working in the internal space is ensured.

(4-6)

The movable portion 89 moves within the horizontal plane. Accordingly, when replacing the former 22, the worker W2 does not need to assume an unstable posture such as leaning their upper body forward.

(4-7)

The movable portion 89 moves by turning from the operating position to the work position. Accordingly, the structure of the maintenance mechanism 80 that enables the movement of the movable portion 89 can be simplified.

(4-8)

The frame 70 supports the packaging unit 14. As such, the overall durability of the weighing and packaging apparatus 10 is improved.

(5) Modification Example A (5-1) Configuration

Figure 11:
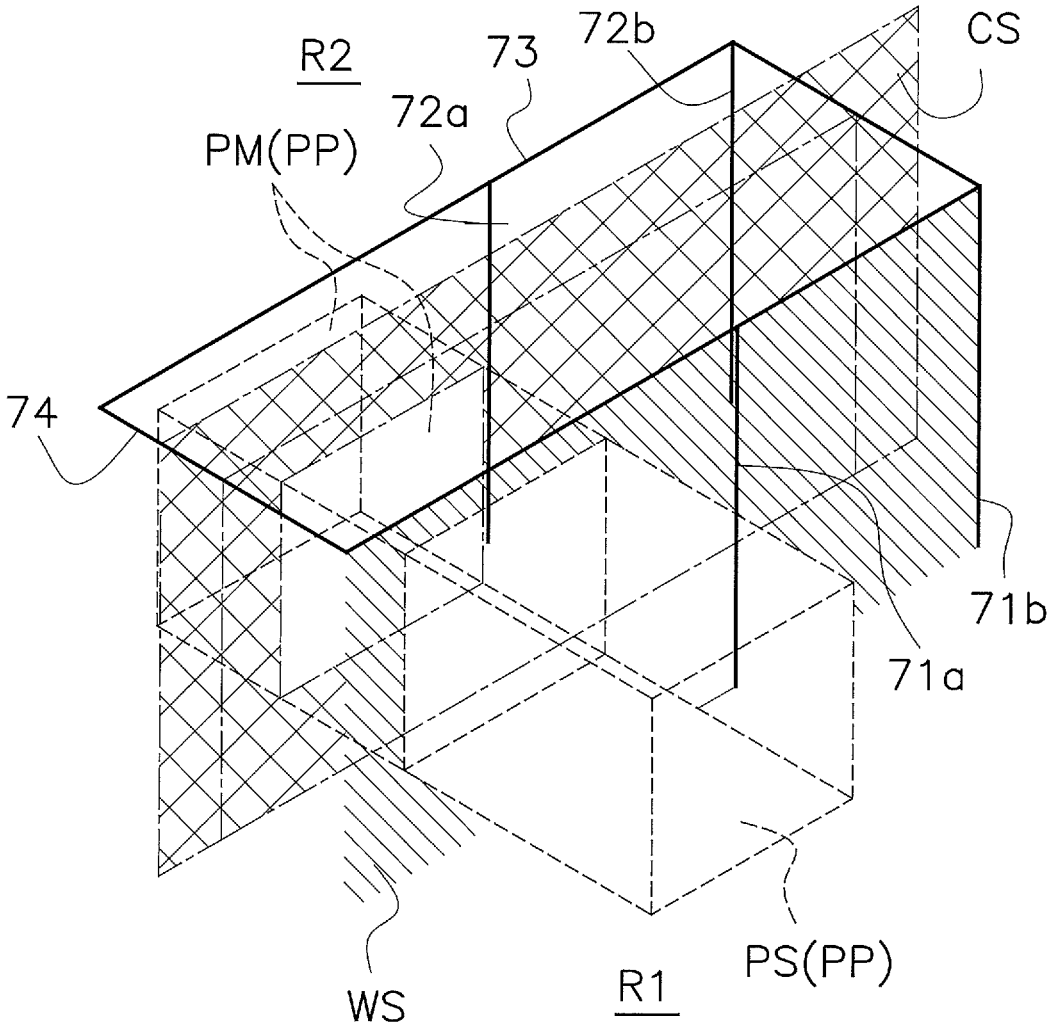
FIG. 11 is a schematic drawing illustrating the structure of the frame 70 of a weighing and packaging apparatus 10A according to Modification Example A of the present invention.
Figure 11:
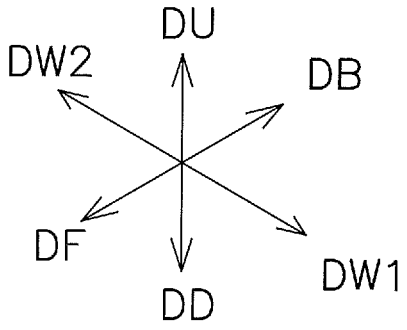

FIG. 11 is a schematic drawing of the frame 70 of a weighing and packaging apparatus 10A according to Modification Example A. Modified Example A is the same as the embodiment described above in that, all of the legs of the frame 70, namely the first front leg 71*a*, the second front leg 72*a*, the first back leg 71*b*, and the second back leg 72*b*, are disposed so as to avoid the leg prohibited space PP. Modified Example A differs from the embodiment described above in that, the first front leg 71*a* and the second front leg 72*a* are disposed on the backward direction DB side of the leg prohibited space PP, thereby avoiding the leg prohibited space PP.

(5-2) Features

With this configuration, none of the first front leg 71*a*, the first back leg 71*b*, the second front leg 72*a*, and the second back leg 72*b* are present on the front direction DF side of the leg prohibited space PP. Accordingly, the worker W2 can utilize the space on the frontward direction DF side where there are no obstacles and, therefore, a degree of freedom in the maintenance work the worker W2 performs is ensured.

(6-2) Modification Example B (6-1) Configuration

With the frame 70 of the weighing and packaging apparatus 10A according to Modification Example A, the second front leg 72*a* is disposed on the backward direction DB side of the leg prohibited space PP, thereby avoiding the leg prohibited space PP. However, alternatively, a configuration is possible in which the second front leg 72*a* is disposed on the frontward direction DF side of the leg prohibited space PP, thereby avoiding the leg prohibited space PP. In this case, the remaining first front leg 71*a*, the first back leg 71*b*, and the second back leg 72*b* are disposed on the backward direction DB side of the leg prohibited space PP, thereby avoiding the leg prohibited space PP.

(6-2) Features

With this configuration as well, a degree of freedom in the maintenance work the worker W2 performs is ensured. In addition, the stability of the frame 70 is improved.

(7) Modification Example C (7-1) Configuration

Figure 12:
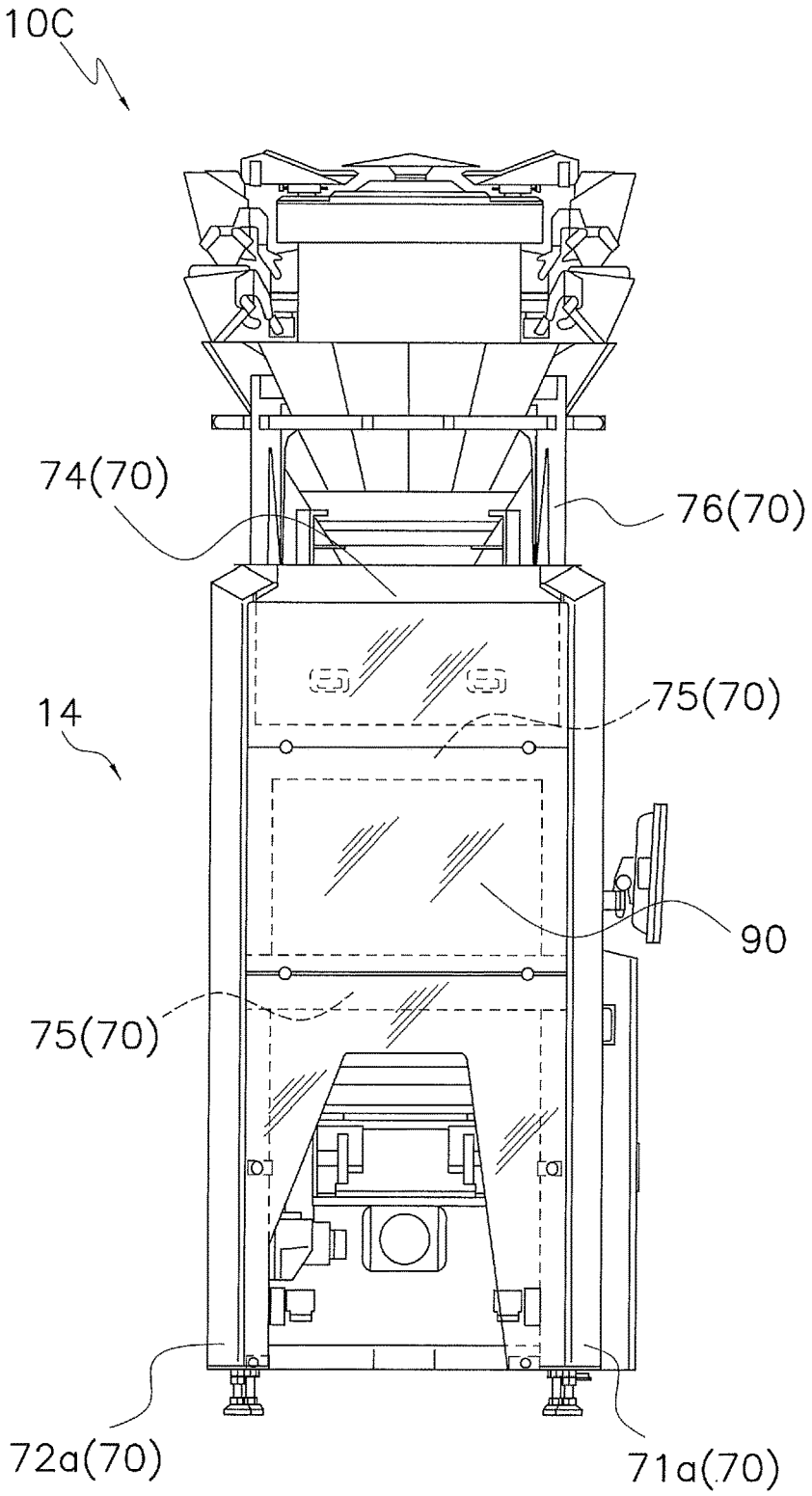
FIG. 12 is a front view illustrating the appearance of a weighing and packaging apparatus 10C according to Modification Example C of the present invention.
Figure 13:
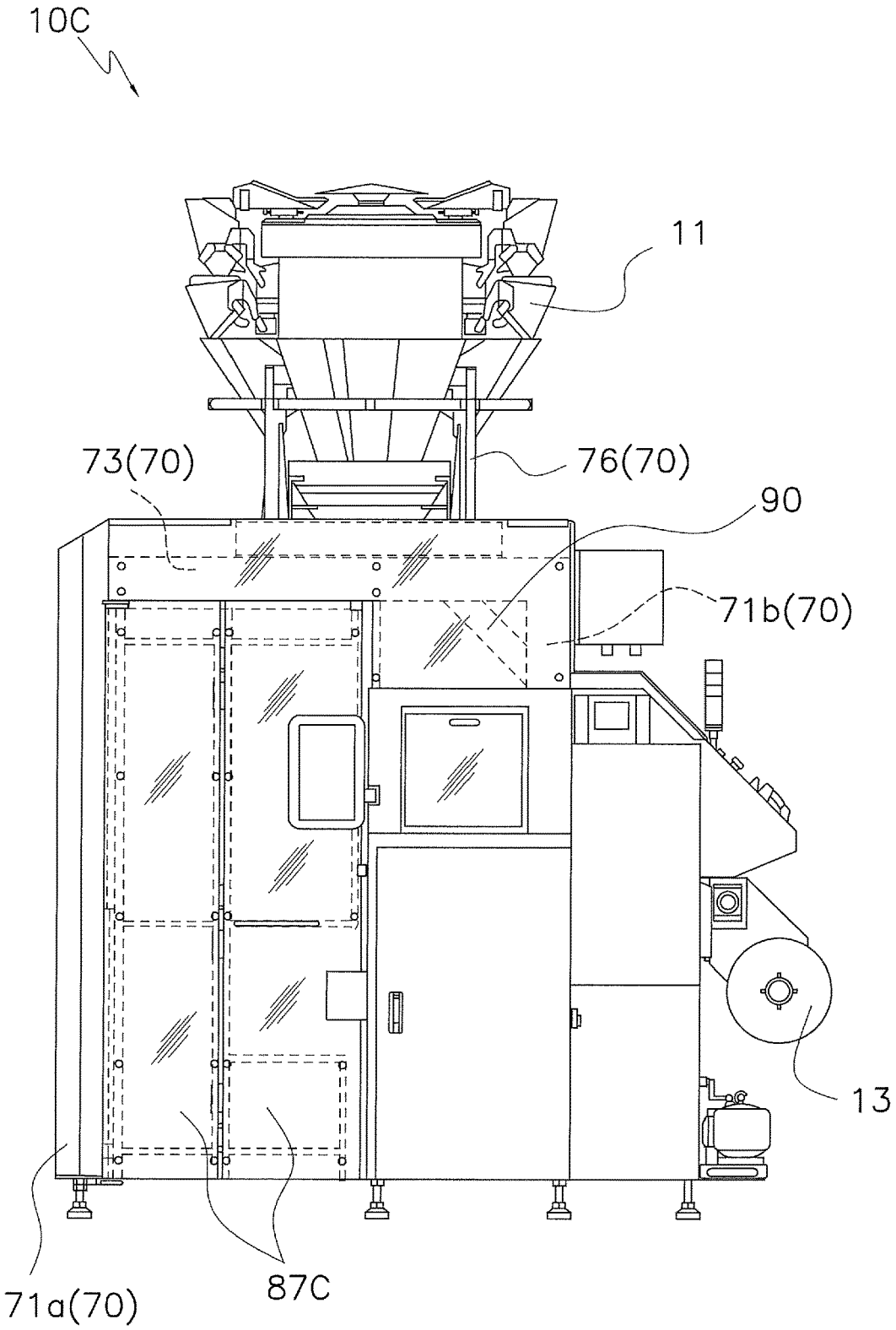
FIG. 13 is a side view illustrating the appearance of the weighing and packaging apparatus 10C according to Modification Example C of the present invention.
Figure 14:
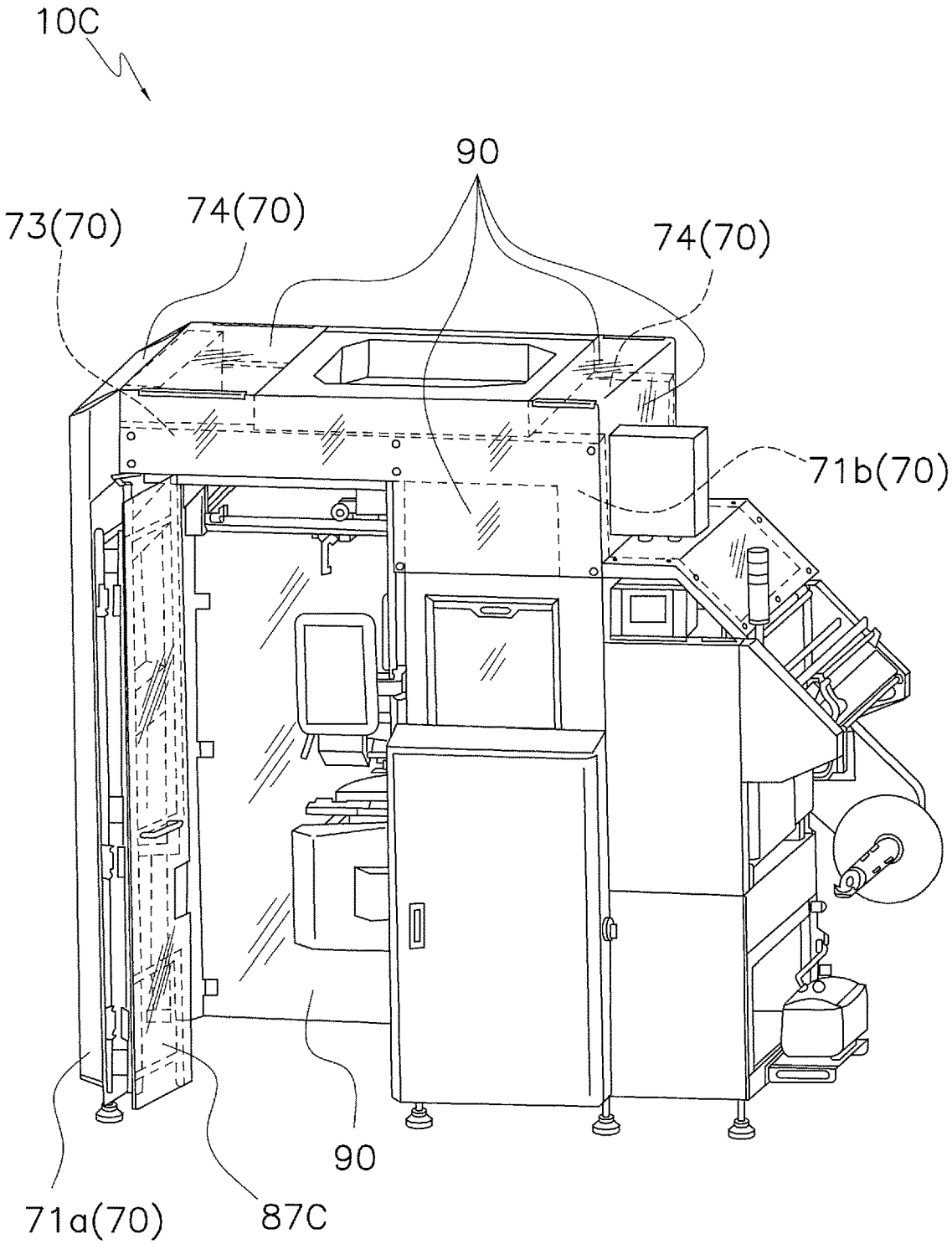
FIG. 14 is a perspective view illustrating the appearance of the weighing and packaging apparatus 10C according to Modification Example C of the present invention.

FIGS. 12 to 14 illustrate a weighing and packaging apparatus 10C according to Modification Example C. Modification Example C differs from the embodiment described above in that the weighing and packaging apparatus 10C includes protective panels 90 that surround the frame 70, and the structure of the safety door 87C is different.

The protective panels 90 prevent the workers from touching the moving portions of the apparatus when the weighing and packaging apparatus 10C is in operation, thereby ensuring the safety of the workers. The protective panels 90 are transparent resin panels and, for example, are made from polycarbonate. As illustrated in FIG. 12, one of the protective panels 90 obstructs passage of the workers by blocking the space between the first front leg 71*a* and the second front leg 72*a*. As illustrated in FIG. 13, one of the protective panels 90 obstructs passage of the workers by blocking the space between the first front leg 71*a* and the first back leg 71*b*. As illustrated in FIG. 14, one of the protective panels 90 obstructs passage of the workers by blocking the space between the second front leg 72*a* and the second back leg 72*b*. Furthermore, one of the protective panels 90 obstructs passage of workers by blocking the space between the first back leg 71*b* and the second back leg 72*b*.

As illustrated in FIGS. 13 and 14, the safety door 87C of the maintenance mechanism 80 has a two-fold structure, but the structure is not limited thereto. The safety door 87C includes a frame and a transparent resin panel installed on the frame. The transparent resin panel is similar to the protective panels 90. In Modification Example C as well, the safety door 87C can be linked to the switch for shutting down the weighing and packaging apparatus 10C.

The protective panels 90 and the safety door 87C cover at least the entire packaging unit 14. When the safety door 87C is open, a worked can, at least partially, enter the space surrounded by the first front leg 71*a*, the first back leg 71*b*, the second front leg 72*a*, the second back leg 72*b*, and the protective panels 90. When the safety door 87C is closed, the protective panels 90 and the safety door 87C surround the space and, as such, workers cannot access the space.

(7-2) Features

With this configuration, the access of workers to the packaging unit 14 can be restricted to a greater degree. Accordingly, the occurrence of accidents in which a worker touches a moving portion of the apparatus can be prevented to a greater degree.

Furthermore, if the safety door 87C is linked to the switch for shutting down the weighing and packaging apparatus 10C, the operations of the weighing and packaging apparatus 10C will stop when the safety door 87 is opened, thereby ensuring the safety of the worker working in the internal space.

REFERENCE SIGNS LIST

10, 10C Weighing and packaging apparatus
11 Weighing unit
12 Inspection unit
13 Film supplying unit
14 Packaging unit
20 Film shaping mechanism
21 Article guide
22 Former
30 Film transport mechanism
50 Lateral sealing mechanism
70 Frame
71*a* First front leg
71*b* First back leg
72*a* Second front leg
72*b* Second back leg
80 Maintenance mechanism
81 Article guide seat
82 Former seat
PM Maintenance mechanism movable space
PP Leg prohibited space
PS Lateral space

CITATION LIST

Patent Literature

Patent Citation 1: Japanese Patent No. 4707441

The invention claimed is:

1. A weighing and packaging apparatus, comprising:

a bag making and packaging unit including a film transport mechanism that transports a film in a film transport direction, a detachable former, a former seat that supports the former, and a sealing mechanism;

a film feed portion that receives the film;

a weighing unit positioned on an upper side in a vertical direction of the bag making and packaging unit, the weighing unit supplying articles to be packaged to the bag making and packaging unit;

a packaged product discharge portion that discharges a product that is packaged; and a frame supporting at least the weighing unit, the frame including a plurality of leg portions; wherein a movable portion including the former seat moves in a maintenance mechanism movable space when the former is attached or detached, all of the plurality of leg portions are located so as to avoid a predetermined leg prohibited space;

a film width direction is orthogonal to a plane including the film transport direction, the leg prohibited space includes the maintenance mechanism movable space, and a lateral space that is adjacent to one side in the film width direction of the maintenance mechanism movable space, a front side is a side of the packaged product discharge portion in a front-back direction perpendicular to both the vertical direction and the film width direction, and a back side is a side, in the front-back direction, of the film feed portion, a space is located between a leg portion on the front side and a leg portion on the back side, the space being unobstructed for a separation distance in the front-back direction from an end on the front side of the sealing mechanism to the leg portion on the front side, and for a height extending from a bottom of the leg portion on the front side to at least a top side of the sealing mechanism; and the apparatus further includes a safety door that is openable and closeable to provide access for a worker into the unobstructed space.

2. The weighing and packaging apparatus according to claim 1, a center plane that divides in the film width direction divides a first region that includes the lateral space and a second region that does not include the lateral space, the plurality of leg portions includes first leg portions disposed in the first region and second leg portions disposed in the second region, and all of the first leg portions are disposed farther to the back side than the lateral space.

3. The weighing and packaging apparatus according to claim 2, wherein the movable portion moves in the maintenance mechanism movable space in directions within a horizontal plane, including the front-back direction and the film width direction.

4. The weighing and packaging apparatus according to claim 3, wherein the movable portion turns in an arc-like manner within the horizontal plane.

5. The weighing and packaging apparatus according to claim 1, wherein at least one of the plurality of leg portions is disposed farther to the front side than the lateral space.

6. The weighing and packaging apparatus according to claim 5, wherein the separation distance is from 300 mm to 800 mm.

7. The weighing and packaging apparatus according to claim 6, wherein the separation distance is from 400 mm to 600 mm.

8. The weighing and packaging apparatus according to claim 5, wherein:

the safety door has a width extending in the front-back direction; and the worker can, at least partially, enter a space surrounded by the safety door and the plurality of leg portions.

9. The weighing and packaging apparatus according to claim 8, further comprising:

a protective panel for preventing passage of the worker by blocking between the plurality of leg portions; wherein the protective panel and the safety door surround the space.

10. The weighing and packaging apparatus according to claim 1, wherein the frame further supports the bag making and packaging unit.

* * * * *